US010239191B2

(12) United States Patent
Tan

(10) Patent No.: US 10,239,191 B2
(45) Date of Patent: Mar. 26, 2019

(54) DUAL FASTENER MANIPULATION DEVICE

(71) Applicant: Xiaoming Tan, Rockville, MD (US)

(72) Inventor: Xiaoming Tan, Rockville, MD (US)

( * ) Notice: Subject to any disclaimer, the term of this patent is extended or adjusted under 35 U.S.C. 154(b) by 235 days.

(21) Appl. No.: 15/436,814

(22) Filed: Feb. 19, 2017

(65) Prior Publication Data

US 2018/0236640 A1 Aug. 23, 2018

(51) Int. Cl.
*B25B 13/48* (2006.01)
*B25B 23/00* (2006.01)

(52) U.S. Cl.
CPC ..... *B25B 13/481* (2013.01); *B25B 23/0007* (2013.01)

(58) Field of Classification Search
CPC ..... B25B 13/48; B25B 13/481; B25B 13/488; B25B 23/0007; B25B 23/0078; B25B 23/0085
See application file for complete search history.

(56) References Cited

U.S. PATENT DOCUMENTS 2,394,027 A * 2/1946 Vlass ..... B25B 13/48 81/55
2,454,027 A * 11/1948 Baeza ..... B25B 23/0085 81/55
2,772,590 A 12/1956 William
2,882,773 A 4/1959 Wing
3,175,433 A 3/1965 Akers
3,277,749 A * 10/1966 Osburn ..... B25B 13/488 81/55
3,731,559 A 5/1973 Krupke
5,062,326 A 11/1991 Goldschmidt
5,460,062 A * 10/1995 Wilson, Jr. ..... B25B 13/48 81/56
5,775,183 A 7/1998 Tavianini
6,345,436 B1 2/2002 Codrington
6,598,500 B1 7/2003 Chivington
8,353,229 B1 * 1/2013 Muhareb ..... B25B 13/08 81/55
8,720,310 B2 * 5/2014 Wang ..... B25B 13/48 81/124.6
9,440,335 B2 9/2016 Correia

* cited by examiner

*Primary Examiner* — David B. Thomas
(74) *Attorney, Agent, or Firm* — Patentfile, LLC; Bradley C. Fach; Steven R. Kick

(57) ABSTRACT

A dual fastener manipulation device may be used to manipulate two fasteners, having the same rotational axis, which may be separated by various distances and various sized objects. The dual fastener manipulation device may include a first wrench having a first fastener engaging head, a first handle, and a pivot stud. A second wrench element may have a second fastener engaging head and a second handle. A pivot linkage may be pivotally coupled to the pivot stud, and a floating stud may be coupled to both the second wrench and to the pivot linkage. The first and second fastener engaging heads may be engaged to two fasteners having the same rotational axis, while the pivot linkage and floating stud may maintain the rotational axis of the fastener engaging heads, while also allowing the fastener engaging heads to be moved closer to or farther from each other.

20 Claims, 5 Drawing Sheets

DUAL FASTENER MANIPULATION DEVICE

FIELD OF THE INVENTION

This patent specification relates to the field of devices configured to simultaneously manipulate more than one fastener. More specifically, this patent specification relates to devices which are able to simultaneously manipulate two fasteners having the same rotational axis.

BACKGROUND

Threaded fasteners provide a convenient and rapid method of fastening or securing objects, whereby rotation in a first direction may be used to tighten or engage the fasteners and rotation in a second direction may be used to loosen or disengage the fasteners. A common method of employing threaded fasteners involves engaging a male fastener, such as a bolt or stud, to a female fastener, such as a nut in the same rotational axis. However, in order to successfully engage the two fasteners together, one of the fasteners must be rotated in a first direction while the other fastener must be prevented from rotating or rotated simultaneously in the second direction. Typically, this process is accomplished using two individual wrenches or other fastener engaging tools in which one or more users attempts to manipulate the individual fastener engaging tools to achieve the desired tightening or loosening. Unfortunately, it is easy for the tools to become dislodged from the fasteners or for the motions of the hands of the one or more users to interfere with each other resulting in inconvenience and possibly injury or fastener damage. Furthermore, difficulty in manipulating two fasteners is greatly increased when the fasteners are separated by material or planar surfaces of material as the material can make it difficult for the one or more users to see and/or reach the fasteners. For this reason, time and resources are often wasted in the manipulation of engaged fasteners.

Therefore a need exists for novel devices which are able to simultaneously manipulate two fasteners having the same rotational axis. There is also a need for novel devices configured to simultaneously manipulate fasteners that are able to prevent the motions of the hands of the one or more users from interfering with each other resulting in inconvenience and possibly injury or fastener damage. A further need exists, for novel devices configured to facilitate the simultaneous manipulation of fasteners having the same rotational axis separated by material or planar surfaces of material. Finally, a need exists for novel time and resource saving devices configured to facilitate the simultaneous manipulation of fasteners having the same rotational axis.

BRIEF SUMMARY OF THE INVENTION

A dual fastener manipulation device is provided. The device may be used to manipulate two fasteners, preferably having the same rotational axis, which may be separated by various distances and various sized objects. The dual fastener manipulation device may include a first wrench having a first fastener engaging head, a first handle, and a pivot stud. A second wrench element may have a second fastener engaging head and a second handle. A pivot linkage may be pivotally coupled to the pivot stud, and a floating stud may be coupled to both the second wrench and to the pivot linkage. The first and second fastener engaging heads may be engaged to two fasteners having the same rotational axis, while the pivot linkage and floating stud may maintain the rotational axis of the fastener engaging heads, while also allowing the fastener engaging heads to be moved closer to or farther from each other.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
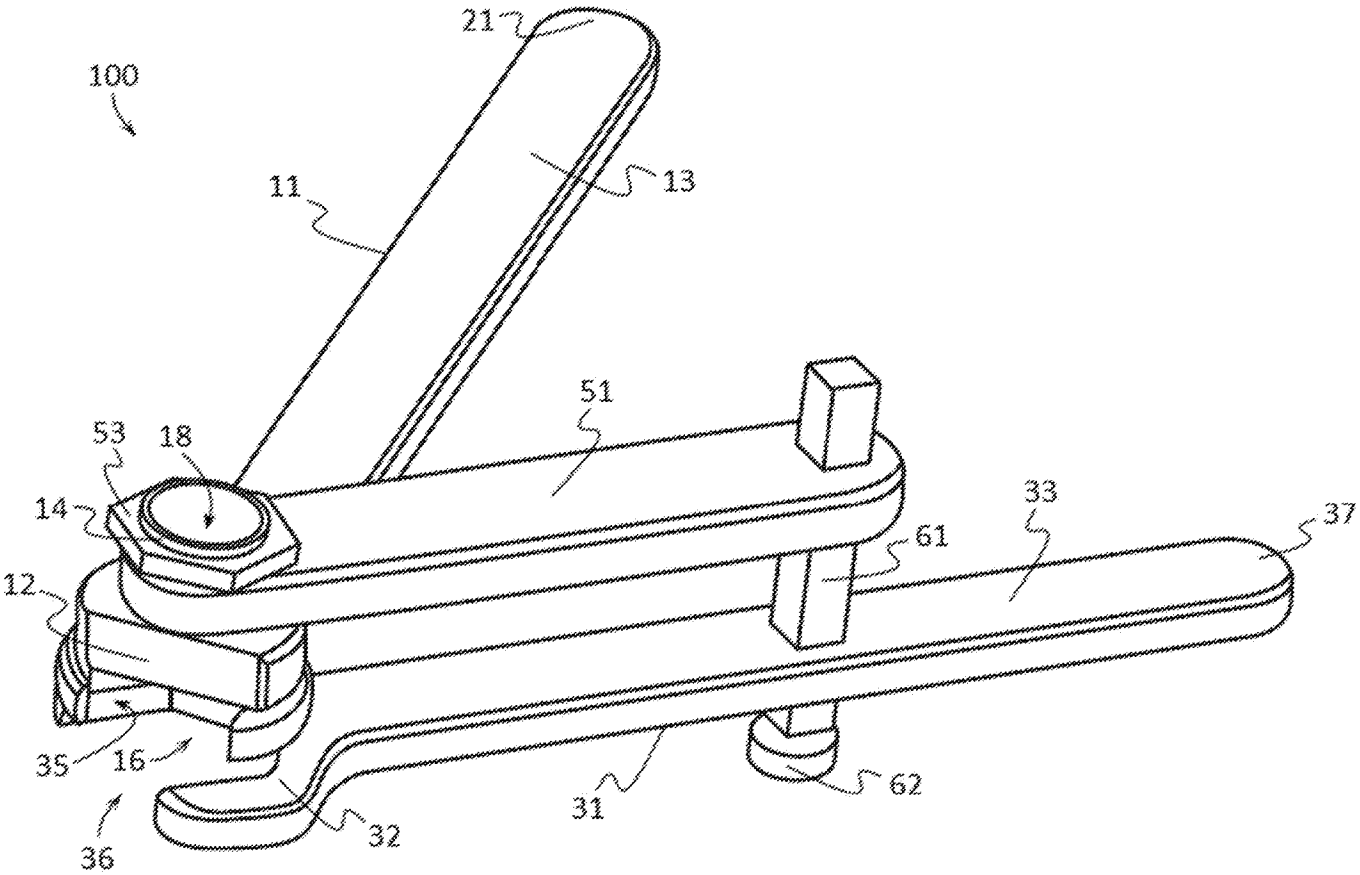
FIG. 1 depicts a top perspective view of an example of a dual fastener manipulation device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

New devices which are able to simultaneously manipulate two fasteners having the same rotational axis are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIGS. 1-5 illustrate an example of a dual fastener manipulation device ("the device") 100 according to various embodiments. In some embodiments, the device 100 may comprise a first wrench 11 having a first fastener engaging head 12, a first handle 13, and a pivot stud 14. A second wrench element 31 may have a second fastener engaging head 32 and a second handle 23. A pivot linkage 51 may be pivotally coupled to the pivot stud 14, and a floating stud 61 may be coupled to both the second wrench 31 and to the pivot linkage 51. The first 12 and second 32 fastener engaging heads may be engaged to two fasteners having the same rotational axis, while the pivot linkage 51 and floating stud 61 may maintain the rotational axis of the fastener engaging heads 12, 32, while also allowing the fastener engaging heads 12, 32, to be moved closer to or farther from each other.

In some embodiments, the first wrench 11 may be made from or comprise a durable material such as aluminum, steel, other metals and metal alloys, hard plastics, or any other suitable rigid material and may comprise a first handle 13 coupled to a first fastener engaging head 12. The first handle 13 may preferably be gripped by an individual and used to apply torque to the first fastener engaging head 12. The first handle 13 may be configured in any size or shape. In preferred embodiments, the first handle 13 may comprise an elongated shape which may provide a greater mechanical advantage to the user when attempting to manipulate a fastener that is engaged by the first fastener engaging head 12. The first handle 13 may be positioned proximate or in contact with the terminal end 21 of the first wrench 11

Figure 2:
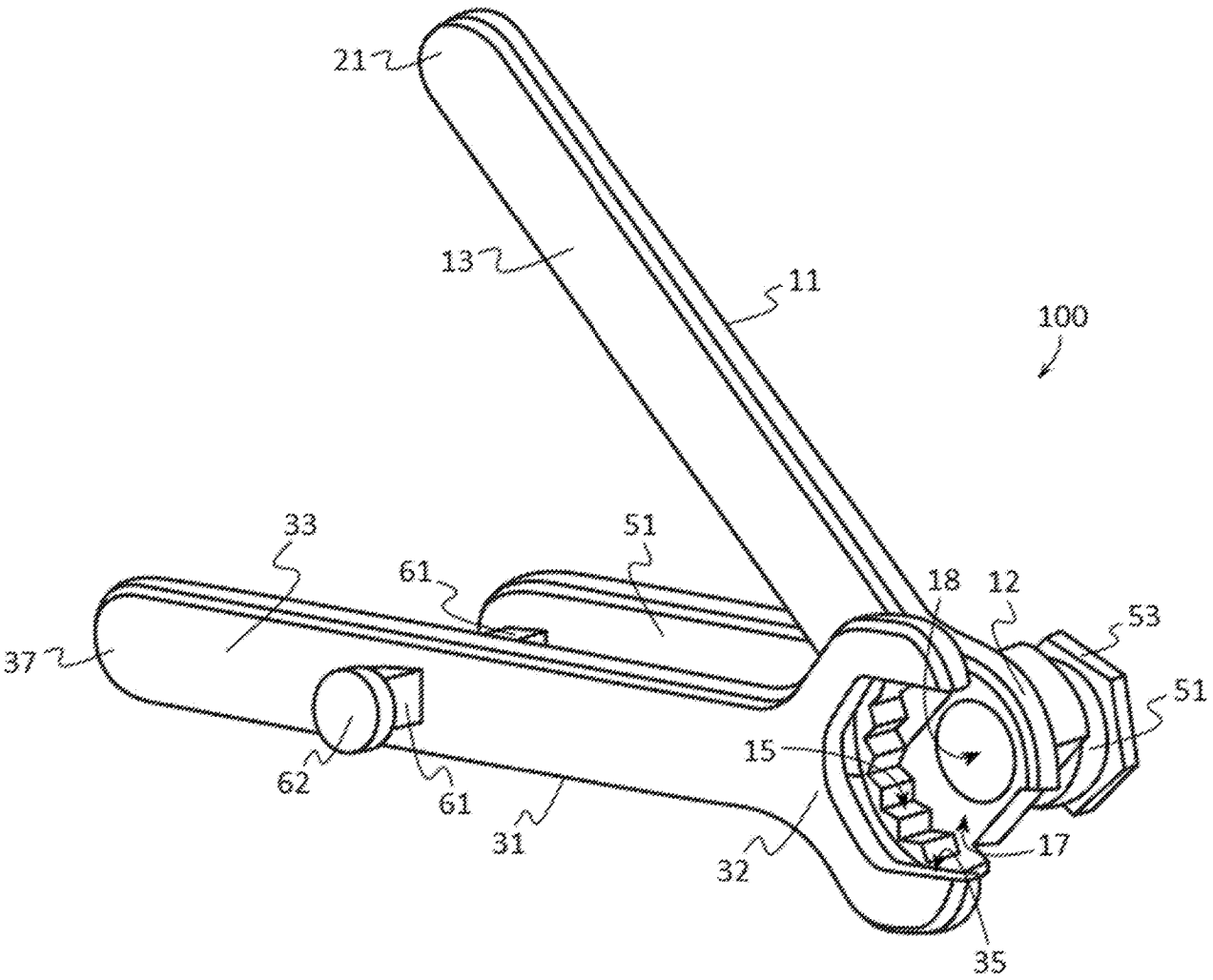
FIG. 2 illustrates a bottom view of an example of a dual fastener manipulation device according to various embodiments described herein.
Figure 3:
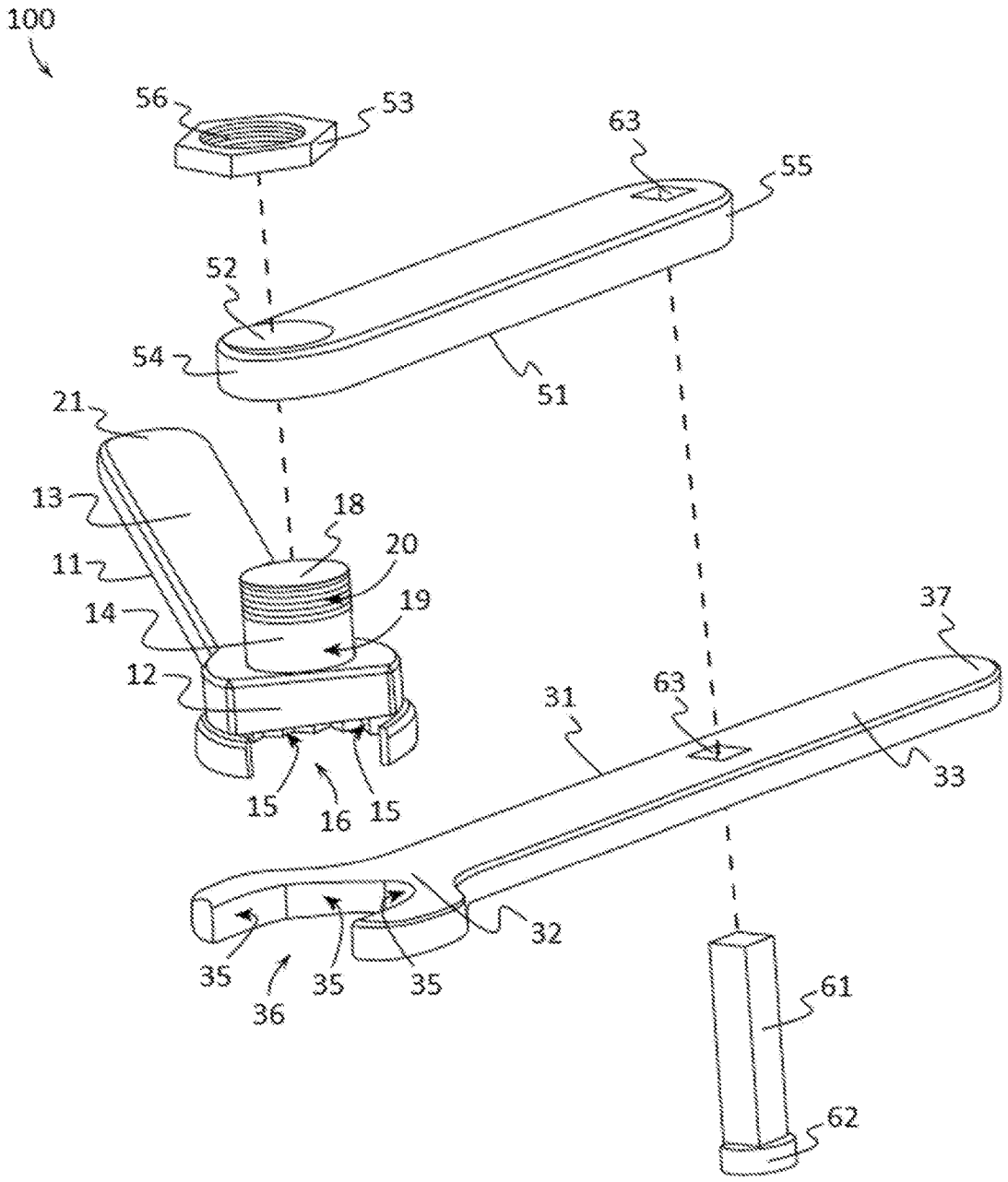
FIG. 3 shows a perspective exploded view of an example of a dual fastener manipulation device according to various embodiments described herein.
Figure 4:
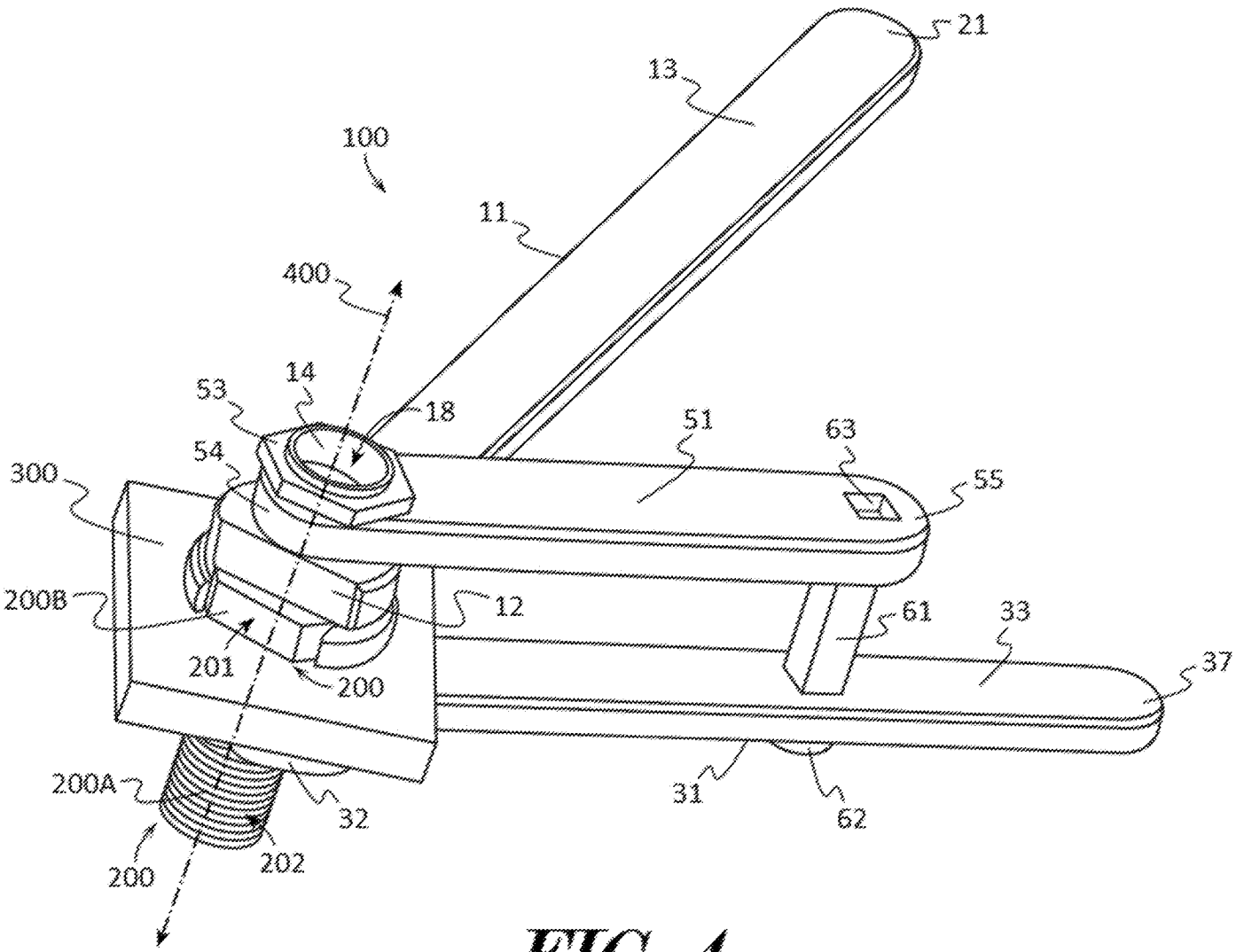
FIG. 4 depicts a top perspective view of an example of a dual fastener manipulation device, according to various embodiments described herein, engaged to two fasteners separated by a unit of material in which the two fasteners have the same rotational axis.

As perhaps best shown in FIGS. 2-4, the first fastener engaging head 12 may be configured to engage a threaded type of fastener 200. Preferably, the first fastener engaging head 12 may be configured to engage male threaded fasteners 200A, such as bolts having a head to which the first fastener engaging head 12 may be engaged to, and female threaded fasteners 200B, such as nuts. Generally, a first fastener engaging head 12 may comprise two or more first fastener engagement surfaces 15 which may be used to grip two or more of the contact surfaces 201 of a fastener 200. For example, a first fastener engaging head 12 may comprise two or more first fastener engagement surfaces 15 which may be used to contact two or more contact surfaces 201 on a four contact surface square nut, a six contact surface hex nut, a wing nut, or any other type of fastener 200.

In preferred embodiments, the first fastener engaging head 12 may comprise a plurality of first fastener engagement surfaces 15 which may be shaped and angled as and positioned in contact with each other similar to a box wrench generally having a six-point, eight-point, or twelve-point opening for use with nuts or bolt heads with a hexagonal shape or square shape. By providing a plurality of first fastener engagement surfaces 15 which may be shaped and angled to contact multiple points on a fastener 200, the first fastener engaging head 12 may fit onto a fastener 200 at many different angles for providing a positioning advantage where swing of the first handle 13 is limited. In further embodiments, the first fastener engaging head 12 may comprise a first opening 16 which may allow the first fastener engaging head 12 to function as an open-ended wrench. In still further embodiments, first fastener engaging head 12 may comprise a U-shape and/or may comprise two parallel and opposing first fastener engagement surfaces 15.

In some embodiments, the first fastener engaging head 12 may comprise one or more stop surfaces 17 against which portions of a fastener 200 may contact or rest when contact surfaces 201 of the fastener 200 are engaged to the first fastener engagement surfaces 15. Optionally, a stop surface 17 may contact the top or bottom surface of the fastener 200 engaged by the first fastener engaging head 12 depending on the orientation of the fastener 200. Preferably, a stop surface 17 may contact the surface of the fastener 200 farthest from the second fastener engaging head 32 of the second wrench 31. A stop surface 17 may comprise a generally flat planar shape as shown in FIG. 2, while in other embodiments, a stop surface 17 may be configured with any other shape, texture, or size.

In some embodiments, the first fastener engaging head 12 may comprise a pivot stud 14 which may be coupled to the first fastener engaging head 12 opposite the first fastener engagement surfaces 15. In further embodiments, the device 100 may comprise a fastener aperture 18 which may extend through the first fastener engaging head 12, such as through a pivot stud 14. In this manner, the fastener aperture 18 may enable a threaded body 202, such as the threading on a stud or threading on a male threaded fastener 200A, to pass through the fastener aperture 18 of the first fastener engaging head 12.

A pivot stud 14 may be used to pivotally couple the pivot linkage 51 to the first wrench 11 and more preferably to the first fastener engaging head 12. Generally, a pivot stud 14 may extend up and away from the first fastener engagement surfaces 15, while being positioned centrally on the first fastener engaging head 12 respective to the first fastener engagement surfaces 15 so that the pivot stud 14 has substantially the same axis of rotation as a fastener 200 received by the first fastener engagement surfaces 15.

In some embodiments, a pivot stud 14 may comprise a pivot surface 19 and a retainer surface 20. Preferably, a pivot surface 19 may be generally smooth, while a retainer surface 20 may comprise threading or be threaded. A pivot linkage 51 may comprise a pivot aperture 52 which may be placed over the pivot stud 14 so that the pivot stud 14 is received in the pivot aperture 52. Preferably, the pivot aperture 52 may have a smooth surface which may be slightly larger than the pivot surface 19 so that the pivot linkage 51 may pivot around the pivot surface 19. Optionally, a linkage retainer 53 may be mated with the retainer surface 20 thereby preventing the pivot linkage 51 from being separated from the pivot stud 14 to pivotally couple the pivot linkage 51 and pivot stud 14. In some embodiments, a linkage retainer 53 may comprise a nut type fastener having threading 56 configured to engage with a retainer surface 20 that is also threaded, a cotter pin, or any other fastener which may be used to retain pivot linkage 51 and pivot stud 14 together in a pivotal relationship. In alternative embodiments, portions of a pivot stud 14 may be peened over or otherwise made larger than portions of the pivot aperture 52 in order to prevent the pivot linkage 51 and pivot stud 14 from separating while providing a pivotal relationship. In further alternative embodiments, a pivot linkage 51 and pivot stud 14 may be coupled together with ball bearings, other types of friction reducing bearings, ratcheting coupling methods, or any other pivotal coupling method.

In some embodiments, the second wrench 31 may be made from or comprise a durable material such as aluminum, steel, other metals and metal alloys, hard plastics, or any other suitable rigid material and may comprise a second handle 33 coupled to a second fastener engaging head 32. The second handle 33 may preferably be gripped by an individual and used to apply torque to the second fastener engaging head 32. The second handle 33 may be configured in any size or shape. In preferred embodiments, the second handle 33 may comprise an elongated shape which may provide a greater mechanical advantage to the user when attempting to manipulate a fastener that is engaged by the second fastener engaging head 32.

Figure 5:
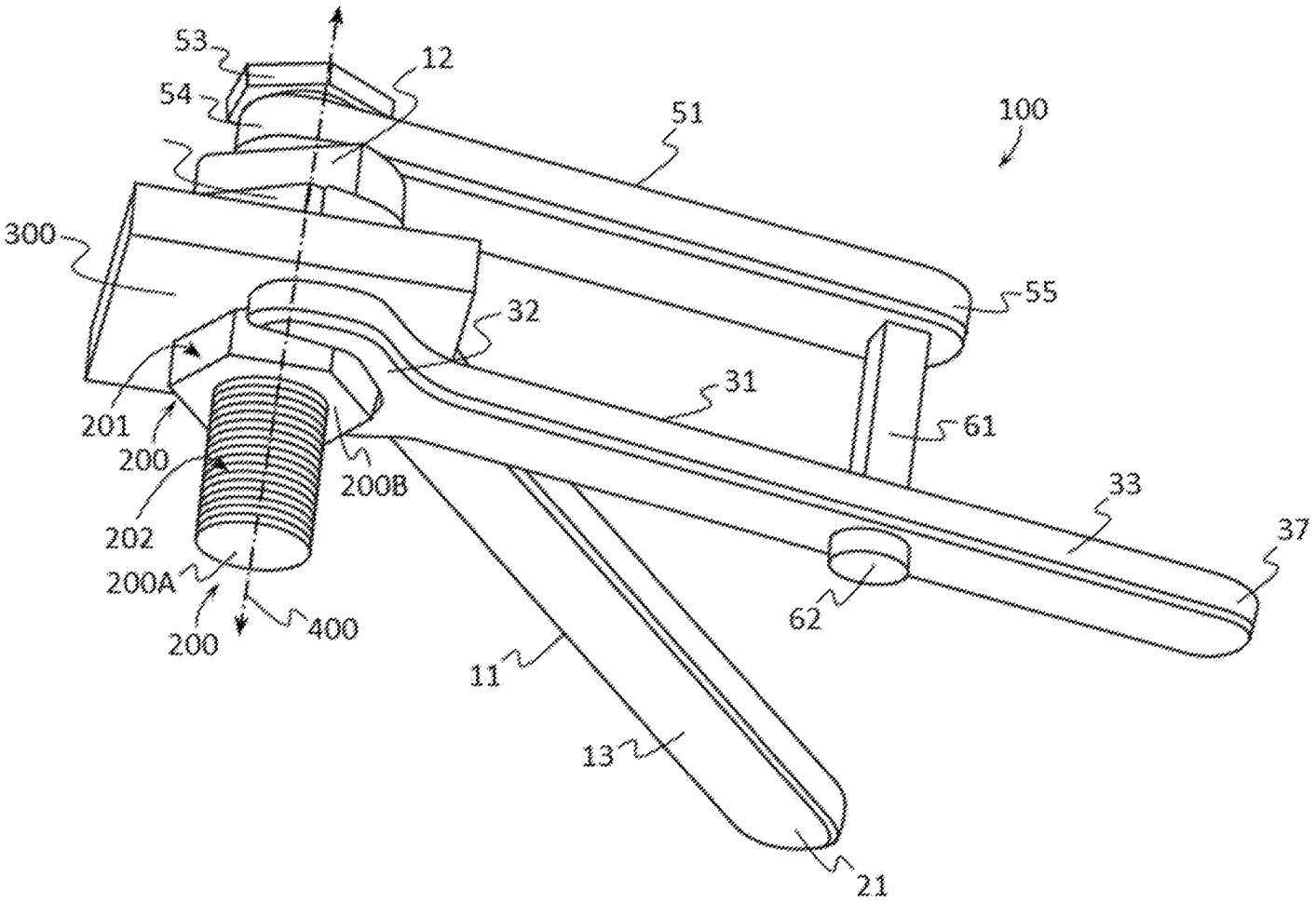
FIG. 5 illustrates a bottom perspective view of an example of a dual fastener manipulation device, according to various embodiments described herein, engaged to two fasteners separated by a unit of material in which the two fasteners have the same rotational axis.

As perhaps best shown in FIGS. 2, 3 and 5, the second fastener engaging head 32 may be configured to engage a threaded type of fastener 200. Preferably, the second fastener engaging head 32 may be configured to engage male threaded fasteners 200A, such as bolts having a head to which the first fastener engaging head 12 may be engaged to, and female threaded fasteners 200B, such as nuts. Generally, a second fastener engaging head 32 may comprise two or more second fastener engagement surfaces 35 which may be used to grip or contact two or more of the contact surfaces 201 of a fastener 200. For example, a second fastener engaging head 32 may comprise two or more second fastener engagement surfaces 35 which may be used to contact two or more contact surfaces 201 on a four contact surface square nut, a six contact surface hex nut, a wing nut, or any other type of fastener 200.

In preferred embodiments, the second fastener engaging head 32 may comprise a second opening 36 which may allow the second fastener engaging head 32 to function as an open-ended wrench. In still further preferred embodiments, second fastener engaging head 32 may comprise a U-shape and/or may comprise two parallel and opposing second fastener engagement surfaces 35. In other embodiments, the second fastener engaging head 32 may comprise a plurality of second fastener engagement surfaces 35 which may be shaped and angled as and positioned in contact with each other similar to a box wrench generally having a six-point, eight-point, or twelve-point opening for use with nuts or bolt heads with a hexagonal shape or square shape.

The device 100 may comprise a floating stud 61 which may be coupled to both the second wrench 31 and to the pivot linkage 51. In some embodiments, a floating stud 61 may be made from or comprise a durable material such as aluminum, steel, other metals and metal alloys, hard plastics, or any other suitable rigid material. A floating stud 61 may movably couple the second wrench 31 to the pivot linkage 51, and therefore to the first wrench 11, while allowing the second wrench 31 to be moved relative to the pivot linkage 51 and therefore to the first wrench 11. Preferably, a floating stud 61 may slidably couple a pivot linkage 51 to the second wrench 31 by being slidably received in a floating aperture 63 of a pivot linkage 51 and/or slidably received in a floating aperture 63 of the second wrench 31. One or more floating apertures 63 maybe positioned anywhere on a pivot linkage 51 and/or anywhere on a second wrench 31, such as between the second fastener engaging head 32 and the terminal end 37 of the second wrench 31.

A floating stud 61 may be configured in any length thereby allowing the second wrench 31 to be moved a desired distance from the pivot linkage 51 and therefore from the first wrench 11. For example, a floating stud 61 having a relatively longer length may enable the second wrench 31 to be moved a relatively larger distance from the pivot linkage 51, while a floating stud 61 having a relatively shorter length may enable the second wrench 31 to be moved a relatively shorter distance from the pivot linkage 51. The travel enable by the length of the floating stud 61 may enable the device 100 to be used to manipulate fasteners 200 having the same axis of rotation that are separated by a plurality of distances and optionally by one or more units of material 300 (FIGS. 4 and 5) having different sizes.

Generally, a floating stud 61 may comprise an elongated shape, such as an elongated rectangular prism shape as shown in FIGS. 1, 3, 4, and 5, an elongated cylindrical shape, an elongated triangular prism shape, an elongated hexagonal prism shape, or any other elongated shape including combinations of shapes. Optionally, a floating stud 61 may comprise one or more slide stops 62 which may limit the movement of the floating stud 61 relative to the second wrench 32 and/or the pivot linkage 51.

In some embodiments, a floating stud 61 may be slidingly coupled to the pivot linkage 51 so that portions of the sliding stud 61 may be moved relative to the pivot linkage 51. In further embodiments, the pivot linkage 51 may comprise a floating aperture 63 which may be complementary shaped to the floating stud 61 and slightly larger than the width of the floating stud 61 so that portions of the floating stud 61 may pass through the floating aperture 63 to allow portions of the floating stud 61 to slide within floating aperture 63 of the pivot linkage 51. For example, a floating stud 61 may comprise an elongated cylinder shape and a floating aperture 63 may comprise a slightly larger cylindrical shape so that the cylindrical portions of the floating stud 61 may slide within the floating aperture 63. An optional slide stop 62 may be shaped larger than the floating aperture 63 so that the slide stop 62 cannot pass through the floating aperture 63 thereby limiting the movement of the floating stud 61 relative to the pivot linkage 51. In alternative embodiments, a floating stud 61 may be coupled to the pivot linkage 51 so that the floating stud 61 and pivot linkage 51 are not movable relative to each other.

In some embodiments, a floating stud 61 may be slidingly coupled to the second wrench 31 so that portions of the sliding stud 61 may be moved relative to the second wrench 31. In further embodiments, the second wrench 31 may comprise a floating aperture 63 which may be complementary shaped to the floating stud 61 and slightly larger than the width of the floating stud 61 so that portions of the floating stud 61 may pass through the floating aperture 63 to allow portions of the floating stud 61 to slide within floating aperture 63 of the second wrench 31. For example, a floating stud 61 may comprise an elongated rectangular prism shape and a floating aperture 63 may comprise a slightly larger rectangular prism shape so that the rectangular prism portions of the floating stud 61 may slide within the floating aperture 63. An optional slide stop 62 may be shaped larger than the floating aperture 63 so that the slide stop 62 cannot pass through the floating aperture 63 thereby limiting the movement of the floating stud 61 relative to the second wrench 31. In alternative embodiments, a floating stud 61 may be coupled to the second wrench 31 so that the floating stud 61 and second wrench 31 are not movable relative to each other.

In some embodiments, a pivot linkage 51 may comprise an elongated shape having a proximal end 54 and a distal end 55. A pivot linkage 51 may be made from or comprise a durable material such as aluminum, steel, other metals and metal alloys, hard plastics, or any other suitable rigid material. The pivot linkage 51 may also comprise a pivot aperture 52 and a floating aperture 63. The pivot aperture 52 may be generally shaped to fit over or receive portions of a pivot stud 14. The floating aperture 63 may be generally shaped to fit over or receive portions of a floating stud 61. In some embodiments, a pivot aperture 52 may be positioned proximate to the proximal end 54, while a floating aperture 63 may be positioned proximate to the distal end 55. In alternative embodiments, one or more pivot apertures 52 and/or floating apertures 63 may be positioned anywhere on a pivot linkage 51.

It should be understood to one of ordinary skill in the art that the wrenches 11, 31, handles 13, 33, pivot stud 14, pivot linkage 51, floating stud 61, and any other element discussed herein may optionally be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

In some embodiments, the first fastener engaging head 12 of the first wrench 11 may be generally configured as an open-ended box wrench and the second fastener engaging head 32 of the second wretch 31 may be generally configured as a U-shaped open-ended wrench. In other embodiments, the first fastener engaging head 12 may be configured as a ratchet wrench having a one-way mechanism which allows the first fastener engagement surfaces 15 of the first fastener engaging head 12 to be turned without removing the first fastener engagement surfaces 15 from the fastener 200 simply by cycling the handle 13 backward and forward. Similarly, in some embodiments, the second fastener engaging head 32 may be configured as a ratchet wrench having a one-way mechanism which allows the second fastener engagement surfaces 35 of the second fastener engaging head 32 to be turned without removing the second fastener engagement surfaces 35 from the fastener 200 simply by cycling the handle 33 backward and forward.

In alternative embodiments, a first fastener engaging head 12 and/or a second fastener engaging head 32 may be configured as a flare-nut wrench, a ratcheting box wrench, a flex-head socket wrench, a spanner wrench, a striking face box wrench, an adjustable wrench, a monkey wrench, a pipe wrench, a breaker bar, a torque wrench, and alligator wrench, a strap or chain wrench, or any other type of wrench having two or more fastener engagement surfaces 15, 35, which may be used to contact and manipulate a fastener 200.

FIGS. 4 and 5 depict an example of a dual fastener manipulation device 100, according to various embodiments described herein, engaged to two fasteners 200 separated by a unit of material 300 in which the two fasteners 200 have the same rotational axis 400. In this example, the device 100 is being used to manipulate an upper female fastener 200B and a lower female fastener 200B separated by a unit of material 300 and which are threaded onto a male fastener 200A. Preferably, the first fastener engaging head 12 of the first wrench 11 may be engaged to the upper female fastener 200B by contacting the first fastener engagement surfaces 15 with the contact surfaces 201 of the upper female fastener 200B. The second fastener engaging head 32 of the second wrench 31 may be engaged to the lower female fastener 200B by contacting the second fastener engagement surfaces 35 with the contact surfaces 201 of the lower female fastener 200B. The floating stud 61 may enable the first wrench 11 and the second wrench 32 to be moved closer and farther from each other so that the first fastener engaging head 12 and second fastener engaging head 32 may be engaged and disengaged with the female fasteners 200B. A user may then grasp and manipulate the handles 13, 33, to rotate the upper and/or lower female fasteners 200B as desired, by rotating one or both handles 13, 33, around the rotational axis 400 of the fasteners 200A, 200B. Additionally, the male threaded fastener 200A may be received or otherwise moved through the fastener aperture 18 and pivot aperture 52 so that the female fasteners 200B may be moved up or down the male fastener 200A unimpeded by the device 100.

While some materials have been provided, in other embodiments, the elements that comprise the device 100 such as the wrenches 11, 31, handles 13, 33, pivot stud 14, pivot linkage 51, floating stud 61, and/or any other element discussed herein may be made from or comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials.

In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A dual fastener manipulation device, the device comprising:

a. a first wrench having a first fastener engaging head and a pivot stud;

b. a second wrench having a second fastener engaging head;

c. a pivot linkage pivotally coupled to the pivot stud; and d. a floating stud coupled to both the second wrench and to the pivot linkage.

2. The device of claim 1, wherein the first wrench comprises a fastener aperture.

3. The device of claim 1, wherein the first wrench comprises stop surface.

4. The device of claim 1, wherein the first wrench comprises two or more first fastener engagement surfaces.

5. The device of claim 1, wherein the second wrench comprises two or more second fastener engagement surfaces.

6. The device of claim 1, wherein the floating stud is slidingly coupled to the pivot linkage.

7. The device of claim 1, wherein the floating stud is slidingly coupled to the second wrench.

8. The device of claim 1, wherein the pivot linkage comprises a pivot aperture, and wherein the pivot stud of the first wrench is received in the pivot aperture.

9. The device of claim 1, wherein the pivot linkage is coupled to the pivot stud with a linkage retainer.

10. The device of claim 1, wherein the second fastener engaging head is U-shaped.

11. The device of claim 1, wherein the second fastener engaging head comprises two parallel and opposing second fastener engagement surfaces.

12. A dual fastener manipulation device, the device comprising:

a. a first wrench having a first fastener engaging head and a pivot stud;

b. a second wrench having a second fastener engaging head;

c. a pivot linkage pivotally coupled to the pivot stud, wherein the pivot linkage comprises a pivot aperture, and wherein the pivot stud of the first wrench is received in the pivot aperture; and d. a floating stud coupled to both the second wrench and to the pivot linkage.

13. The device of claim 12, wherein the first wrench comprises a fastener aperture.

14. The device of claim 12, wherein the first wrench comprises Stop surface.

15. The device of claim 12, wherein the first wrench comprises two or more first fastener engagement surfaces.

16. The device of claim 12, wherein the second wrench comprises two or more second fastener engagement surfaces.

17. The device of claim 12, wherein the floating stud is slidingly coupled to the pivot linkage.

18. The device of claim 12, wherein the floating stud is slidingly coupled to the second wrench.

19. The device of claim 12, wherein the pivot linkage is coupled to the pivot stud with a linkage retainer.

20. The device of claim 12, wherein the second fastener engaging head is U-shaped, and wherein the second fastener engaging head comprises two parallel and opposing second fastener engagement surfaces.

* * * * *